United States Patent [19]

Hodler

[11] 4,239,080

[45] Dec. 16, 1980

[54] DIECASTING VENTING VALVE

[76] Inventor: Fritz Hodler, Chemin du Chatagny 3, CH 1820 Territet, Switzerland

[21] Appl. No.: 961,533

[22] Filed: Nov. 16, 1978

[30] Foreign Application Priority Data

Nov. 17, 1977 [DE] Fed. Rep. of Germany ..... 2751431

[51] Int. Cl.[3] ..... B22D 17/22

[52] U.S. Cl. ..... 164/305; 251/58

[58] Field of Search ..... 164/305, 410; 251/58, 251/62, 63.4

[56] References Cited

U.S. PATENT DOCUMENTS

| | | | |
|---|---|---|---|
| 388,860 | 9/1888 | Greenwood | 251/62 |
| 3,885,618 | 5/1975 | Hodler | 164/305 |

FOREIGN PATENT DOCUMENTS 306274 6/1955 Switzerland .

*Primary Examiner*—Robert D. Baldwin

*Attorney, Agent, or Firm*—Hill, Van Santen, Steadman, Chiara & Simpson

[57] ABSTRACT

A venting valve arrangement for diecasting molds comprises a venting conduit for venting the mold cavity, a valve piston in the venting conduit, and an actuating piston exposed to the action of the casting material. The actuating piston and the valve piston have substantially parallel axes and are interconnected by a positive interlock of the two pistons, or parts actuated by the pistons in the manner of followers. Several axially parallel adjacent actuating pistons may be provided, all acting upon a common transmission piston.

11 Claims, 5 Drawing Figures

DIECASTING VENTING VALVE

The invention relates to a venting valve arrangement for diecasting molds, said arrangement comprising a venting conduit emerging from the mold cavity, a valve piston in the conduit, and an actuating piston exposed to the action of the casting material, the actuating piston being in a motion transmissive connection with the valve piston, which is disposed substantially parallel to the axis of the actuating piston.

Such a venting valve arrangement is already known from Swiss Patent Specification No. 306 274. In the arrangement disclosed in this specification, the motion transmissive connection between the actuating piston and the valve piston is provided by a rocking lever on which both pistons are articulated. When the actuating pistons moves the rocking lever is slewed, which imparts to the valve piston a corresponding travel, resulting in the closing or opening of the valve according to the slewing sense of the rocking level.

This conventional valve arrangement, however, is generally applicable to only small valves, which are suitable for only small mold cavities for small castings. Yet even in this case the lever mechanism must be of high precision, which makes the production of the valve arrangement complicated, without being able to preclude functional failure. Since the two pistons have guide cylinders of fixed axial length, any more or less marked oblique deviation of the rocking lever from its position normal to the axes of the cylinders may lead to stresses in the piston guides. To avoid this special means must be provided at the articulation points of the pistons on the rocking lever, in order to compensate for the contraction of spacing of the pivotal points of the piston arising from the change in the angle of the rocking lever in projection onto a plane at right angles to the piston axes.

According to the present invention, there is provided a venting valve arrangement for diecasting molds, said arrangement comprising a venting conduit for venting the mold cavity, a valve piston in the venting conduit, and an actuating piston exposed to the action of the casting material, the actuating piston and the valve piston having substantially parallel axes and being interconnected by a positive interlock of the two pistons, or parts actuated by the pistons, in the manner of followers.

Thus the transmission of motion between actuating piston and valve pistons is effected by a kind of follower engaging in between two abutment faces on the other piston. This follower may be formed as a member upon one of the two pistons, which member projects substantially radially towards the other piston, with which this piston co-acts. The follower may be formed as a plate, the edge of which engages with a groove on the other piston with radial play. The design of the motion transmissive connection between the actuating piston and the valve piston ensures correct operation without high precision in the design and production of the parts. Since, further, the mode of connection allows some radial play in the interengaging parts of the two pistons or of members fixed to these or co-acting with them, no malfunction can arise from thermal expansion of the interengaging parts.

Nevertheless, in the presence of very high thermal stresses the two pistons may become jammed in their cylinders if the piston becomes hotter than and so expands more than the receiving cylinder. In order largely to eliminate this danger, in an advantageous form of embodiment of the venting valve arrangement according to the invention there are provided several actuating pistons which are arranged beside one another in a parallel array and co-act with a member projecting towards the valve piston, said member engaging between two abutment faces on at least one valve piston. For the same purpose, instead of one venting piston, there may be provided several, with the follower element, for instance in the form of a follower disk, acted upon by the actuating pistons or connected therewith, being connected with all the valve pistons in the power transmitting manner. According to the number of the actuating and/or valve pistons, their diameter may be made correspondingly smaller than the diameter of a single actuating and/or valve piston, in order to ensure an equally good performance and be able to withdraw an equally large amount of gas from the casting mold. With these smaller diameters the piston play can be smaller than in the case of larger piston diameters, without jamming or blockage at high temperatures, so that the risk of the highly fluid metal being forced under the high metal pressures involved in between the piston and the cylinder walls and making the valve inoperative is eliminated. The provision of a plurality of actuating pistons and, if required, of valve pistons presents the additional advantage that, owing to their easier mobility in the receiving cylinders, the force needed to return the pistons to their starting position can be reduced. This, consequently, requires only a relatively weak returning spring, and the pins which are often employed for relieving the high expulsion force necessitated by the great diameter of the actuating piston become superfluous.

In addition, to counteract the jamming or blocking of the piston, it may also be of advantage so to dimension the immersion depth of this actuating and/or valve piston, which is formed as a plunger, that it corresponds to at least a quarter of the piston diameter at its sealing head end. By the immersion depth is here to be understood that axial length of the cylinder receiving the piston over which the outer head face of the piston can be moved into the cylinder walls sealing it off.

Owing to this comparatively deep immersion, the casting material comes into contact with equally large areas of the cylinder walls and of the piston head, so that it passes onto the cylinder at least as great an amount of heat as it does to the piston. As a result the enlargement of the cylinder diameter due to the rise in temperature is not less than the enlargement of the piston diameter, so that the initial wall play between the piston and the cylinder is maintained. It is, therefore, enough to apply only a very small returning force to the valve piston in order to move it into its open position.

The invention will now be further described, by way of example, with reference to the accompanying drawings, in which.

Figure 1:
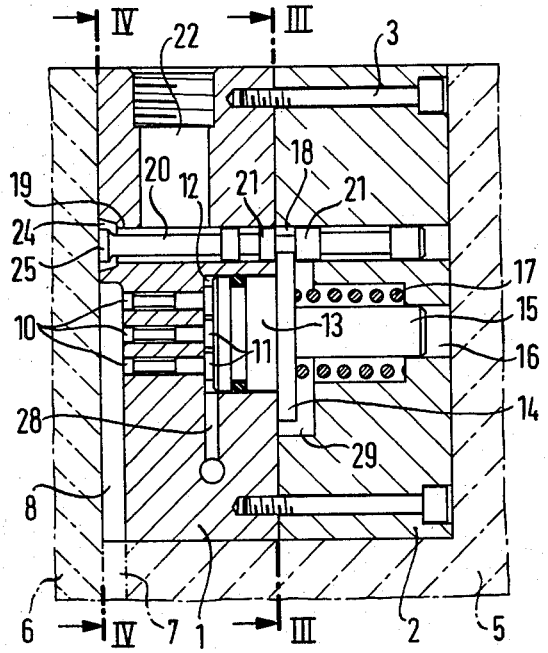
FIG. 1 shows a vertical section through a valve arrangement according to the invention with valve pistons in the open position.

In the form of embodiment illustrated in the drawings, the venting valve arrangement consists of a block unit, which comprises two block parts 1,2, connected to each other by bolts 3. This block unit can be screwed on to one half of a diecasting mold by means of further securing bolts 4, in such a way that it bears with its outer side shown in FIG. 4 against the other half 6 of the mold.

Figure 2:
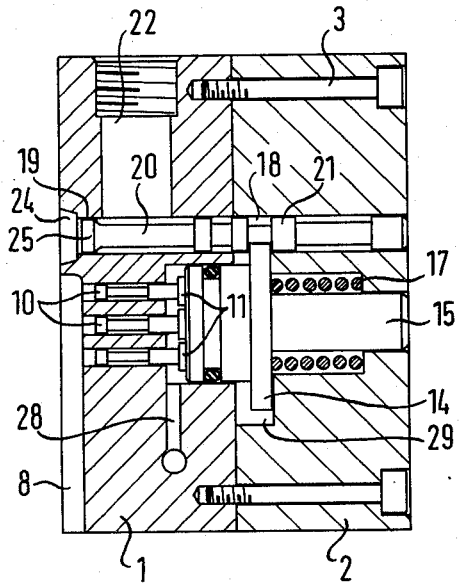
FIG. 2 shows a similar vertical section through the valve arrangement of FIG. 1 with valve pistons in the closed position.

In the illustrated embodiment, the mold half 5 indicated on the right in FIGS. 1 and 2 is equipped with a venting conduit 7, which has an extension 8 in the block part of the valve arrangement. At its end, the conduit extension 8 is provided with a widening 9 into which the cylinders of five actuating pistons 10 open (see FIG. 4). These actuating cylinders are formed as plungers, and at their end facing away from the widening 9 are provided with shoulders 11, which lie within a cylindrical space 12, and which serve as stops for defining the starting position of the actuating pistons. Axially slidable in this cylindrical space is a transmission piston 13, which carries at its head end facing away from the actuating piston 10 a follower disk 14, rotatable about the axis of the piston. For this purpose it may be rotatably seated upon a piston rod 15, which is arranged on that side of the transmission piston 13 which faces away from the actuating pistons 10, and is guided at its end in a bore 16 of the block part 2. The piston rod 15 is surrounded by a pressure spring 17, which through the follower plate 14 urges the transmission piston 13 into its left hand end position in chamber 29 shown in FIG. 1, in which the actuating pistons occupy their starting position.

Two venting pistons 20 are axially slidably mounted in cylinders 19 which lie parallel to the axes of the actuating pistons. Each of these actuating pistons has in the middle of its length an annular groove 18, which may be formed by turning or by the use of two collars 21. An outlet 22 opens out into the cylinder 19 for the valve piston 20. When the valve piston 20 is in its open position (FIG. 1) this outlet communicates through the cylinder 19 and branch ducts 23 (FIG. 4) with the continuation 8 of the venting conduit 7. These branch ducts 23 start at right angles off the conduit extension 8 and are multiple branched, the last branch 23*a* opening out into a chamber 24, which communicates with the cylinder 19 of one of the valve pistons 20.

At the end of the filling of the unillustrated mold cavity, and before liquid casting material reaches the conduit extension 8 through the conduit for venting 7, the actuating pistons 10 are forced into their starting positions shown in FIG. 1 by the pressure spring 17 via the follower plate 14 and the transmission piston 13. Once the casting material has filled the widening 9 at the end of the conduit extension 8, it will tend to enter the branch ducts 23. Since the combined cross section of the branch ducts where they start off from the conduit extension 8 is substantially smaller than the cross section of the conduit extension itself, the pressure in the widening 9 will rise so that the actuating pistons will be pressed into their terminal position shown in FIG. 2 against the action of the spring. At the same time they will move the transmission piston 13 with the follower plate 14 to the right in the drawing, the follower plate, owing to its positive engagement in the groove 18, moving the valve pistons 20 into their closing position, also shown in FIG. 2. This causes the piston head 25 to move into the cylinder 19, thus interrupting the communication between the chamber 24 and the outlet 22. In this way the outlet of the venting conduit is closed and the casting material which has in the meantime entered the chamber 24 through the branch ducts 23 cannot penetrate the outlet 22 and spurt out of this.

Figure 4:
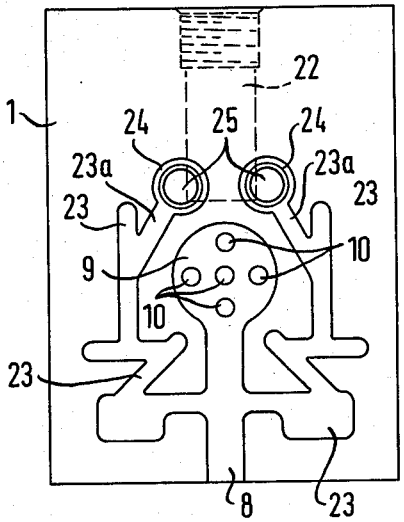
FIG. 4 is a front elevation of the other block part in the direction of the arrow IV—IV in FIG. 1.

Owing to the branching of the branch ducts 23 shown in FIG. 4, the metal splutter or small metal jets which may precede the compact stream of metal are unable to reach the chamber 24 before the metal stream has filled up the widening 9 and moved the actuating pistons into their terminal position illustrated in FIG. 2, in which the venting valve is closed.

Figure 5:
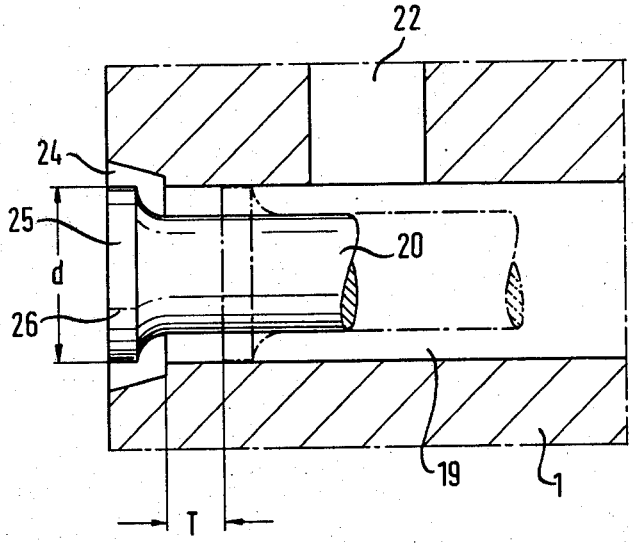
FIG. 5 illustrates an axial section through a valve piston and a cylinder receiving the piston, on a larger scale than in FIGS. 1 and 2.

Both the actuating pistons 10 and the valve pistons 20 are formed as plungers. The design of the valve piston is such that in its terminal position which is shown in FIG. 5 in interrupted lines, the outer head face 26 (FIG. 5) which comes into contact with the casting material finds itself inside the cylinder walls, which tightly fit the piston, by an axial distance T that corresponds to at least a quarter of the diameter d of the piston head 25. This ensures that, owing to the depth of immersion, the walls at the end of the cylinder which come into contact with the hot casting material receive at least as much heat as the piston head 25 through its head face 26, as a result of which the thermally mediated increase in the diameter of the cylinder is at least equal to that of the piston head guided therein. This feature can also apply to the heads of the actuating pistons 10.

Figure 3:
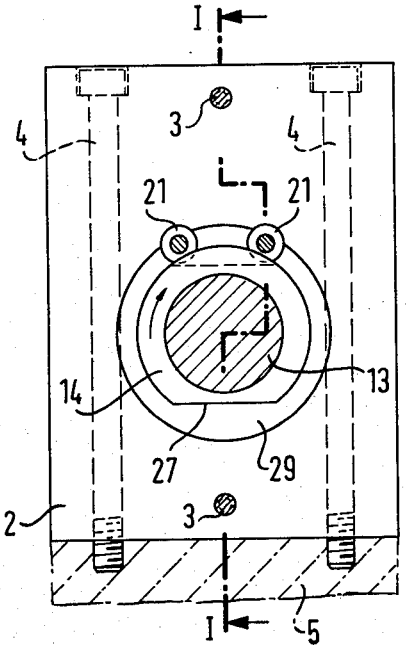
FIG. 3 shows a view of one of the two block parts of this arrangement in the direction of the arrow III in FIG. 1.

For reasons of assembly the follower disk 14 is located in a chamber 29 in the block part 2, which is open towards the block part 1. Its edge has a flat portion 27. This flat portion is so dimensioned that in the angular position of the follower disk where the flat portion assumes the position shown in FIG. 3 in dashed lines the follower plate is out of engagement with the groove 18 on the valve piston. Thus in this angular (rotational) position, when the block parts 1,2 are separated from each other, the disk 14 together with the transmission piston 13 and the piston rod 15 can be moved out of the block part 2 past the salients 21 of the valve piston 20 which form the groove 18, while the valve piston can stay in said block part 2. Conversely it is possible to pull out the valve piston from its cylinder 19 without entraining the follower disk 14, the transmission plate 13 and the piston rod 15.

A pressure duct 28, which comes from a source of pressure fluid and through which it is possible to test the functioning of the venting valve before the casting operation, opens out into the cylindrical space 12, located between the actuating piston 10 and the transmission piston 13.

What I claim is:

1. A venting valve arrangement for diecasting molds, said arrangement comprising a venting conduit for venting the mold cavity, at least one venting valve piston in the venting conduit, several axially parallel adjacent actuating pistons exposed to the action of the casting material, the actuating pistons and the venting valve piston having substantially parallel axes, a follower loosely interconnecting the venting valve piston with the actuating pistons, said several axially parallel adjacent actuating pistons all acting upon a common transmission piston, the follower projecting towards the venting valve piston in a radial direction with respect to said transmission piston, and means positively attaching said follower to said at least one of the venting valve pistons and with said follower providing a positive interlock of the venting valve piston with the actuating pistons.

2. The valve arrangement of claim 1 further characterized by said positive interlock comprising a non-pivoting connection between said follower and the venting valve piston and also between said follower and said actuating piston.

3. A valve arrangment according to claim 1, wherein said follower includes a member connected with said transmission piston and which member projects substantially radially towards the venting valve piston, and fits in between two abutment faces on the venting valve piston.

4. A valve arrangement according to claim 3, the transmission piston being mounted in a cylinder, a pressure medium duct connected to said cylinder, and a pressure discharge source connected to said pressure medium duct and said cylinder for axially moving said transmission piston.

5. A valve arrangement according to claim 1, wherein said transmission piston is provided with a follower disk, the edge of which engages in a groove on the venting valve piston with radial play.

6. A valve arrangement according to claim 1, wherein the actuating pistons and the venting valve piston are plungers whose depth of immersion in a conduit in the closed position is equal to at least a quarter of the piston's diameter at its sealing head end.

7. A valve arrangement according to claim 1, wherein the cylinder of the venting valve piston communicates with the venting conduit leading to the actuating pistons by at least one branch duct which branches off from the venting conduit before the actuating pistons.

8. A valve arrangement according to claim 7, wherein every branch duct is multiple branched in such a way that before the end of a branch, a branch following it on the way to the cylinder leads off in a direction that deviates from the direction of the preceding branch by at least some 30°.

9. A valve arrangement according to claim 1, wherein the venting valve piston is a plunger whose depth of immersion in a conduit in the closed position is equal to at least a quarter of the piston's diameter at its sealing head end.

10. A venting valve arrangement for diecasting molds, said arrangement comprising a venting conduit for venting the mold cavity, at least one venting valve piston in the venting conduit, at least one actuating piston exposed to the action of the casting material, the actuating piston and the venting valve piston having substantially parallel axes, and means loosely interconnecting the venting valve piston with the actuating piston, said means providing a positive interlock of the two pistons, said means including a member connected with one of said pistons and which member projects substantially radially towards the other piston, and fits in between two abutment faces on the other piston, said member being a follower disk, the edge of which engages in a groove formed by the abutment faces on the venting valve piston with radial play, the actuating and the valve venting pistons being provided in a block body that is divided into two parts, the follower disk being located in a chamber in one block part, the other block part being open and so proportioned that when the venting valve piston is closed, the follower disk is in contact with the base of the chamber.

11. A venting valve arrangement for diecasting molds, said arrangement comprising a venting conduit for venting the mold cavity, at least one venting valve piston in the venting conduit, at least one actuating piston exposed to the action of the casting material and acting on a transmission piston, the actuating piston and the venting valve piston having substantially parallel axes, and means loosely interconnecting the venting valve piston with this actuating piston, said means providing a positive interlock of the actuating and venting valve pistons, said means including a member connected with one of said pistons and which member projects substantially radially towards the other piston, and fits in between two abutment faces on the other piston, said member being a follower disk, the edge of which engages in a groove formed by said abutment faces on the venting valve piston with radial play, the follower disk being rotatable about the axis of the transmission piston and having a portion of its edge cut away so that it can be disengaged from the abutment faces on the venting valve piston when it is rotated so that the cut away portion registers with the abutment face.

* * * * *